US008866569B2

(12) United States Patent
Huang

(10) Patent No.: US 8,866,569 B2
(45) Date of Patent: Oct. 21, 2014

(54) PRY PLATE TRIPPING CIRCUIT BREAKER

(71) Applicant: Wenzhou New Blud Sky Elecricial Co., Ltd., Wenzhou (CN)

(72) Inventor: Mingguang Huang, Wenzhou (CN)

(73) Assignee: Wenzhou New Blue Sky Electrical Co., Ltd., Wenzhou, Zhejiang (CN)

( * ) Notice: Subject to any disclaimer, the term of this patent is extended or adjusted under 35 U.S.C. 154(b) by 0 days.

(21) Appl. No.: 13/949,553

(22) Filed: Jul. 24, 2013

(65) Prior Publication Data

US 2014/0118096 A1 May 1, 2014

(30) Foreign Application Priority Data

Oct. 25, 2012 (CN) ..... 2012 1 0417241

(51) Int. Cl.
*H01H 9/00* (2006.01)
*H01H 3/32* (2006.01)

(52) U.S. Cl.
CPC ..... *H01H 3/32* (2013.01)
USPC ..... 335/174; 335/6

(58) Field of Classification Search
USPC ..... 335/174
See application file for complete search history.

(56) References Cited

U.S. PATENT DOCUMENTS 2,824,191 A * 2/1958 Christensen ..... 337/50
2,942,083 A * 6/1960 Reichert et al. ..... 218/149
2,989,604 A * 6/1961 Wegh ..... 335/6
3,401,363 A * 9/1968 Vyskocil et al. ..... 335/17
3,596,219 A * 7/1971 Erickson ..... 335/17
3,760,308 A * 9/1973 Misencik et al. ..... 335/35
4,417,222 A * 11/1983 Schmitt et al. ..... 335/6
4,616,200 A * 10/1986 Fixemer et al. ..... 335/35
5,130,684 A * 7/1992 Scott et al. ..... 335/43
5,245,302 A * 9/1993 Brune et al. ..... 335/35
5,546,060 A * 8/1996 Mrenna ..... 335/35
6,242,993 B1 * 6/2001 Fleege et al. ..... 335/18
6,591,482 B1 * 7/2003 Fleege et al. ..... 29/605
7,518,482 B2 * 4/2009 Fleege ..... 337/59
7,551,050 B2 * 6/2009 Annis et al. ..... 335/201
7,812,276 B2 * 10/2010 Maloney et al. ..... 218/148
7,864,004 B2 * 1/2011 Dominguez et al. ..... 335/8
2013/0207768 A1 * 8/2013 Lehmann et al. ..... 337/3

* cited by examiner

*Primary Examiner* — Shawki S Ismail
*Assistant Examiner* — Lisa Homza

(57) ABSTRACT

A pry plate tripping circuit breaker includes a housing, an operation mechanism, a lock catch, a tripping mechanism, a movable contact, an immovable contact, an arc extinguish chamber and a bimetallic strip. The lock catch includes a lock portion to cooperate with the operation mechanism and an action portion to cooperate with the tripping mechanism. The trigging mechanism includes a pry plate unit and a drive unit to drive the pry plate unit. The drive unit includes a conductive plate electrically connected with the bimetallic strip and an electromagnetic induction member on the conductive plate. The pry plate unit includes a pry plate. One end of the pry plate is provided with an armature, and another end of the pry plate corresponds to the action portion of the lock catch. The pry plate is provided with an elastic member.

4 Claims, 9 Drawing Sheets

PRY PLATE TRIPPING CIRCUIT BREAKER

BACKGROUND OF THE INVENTION

1. Field of the Invention

The present invention relates to a circuit breaker, and more particularly to a pry plate tripping circuit breaker.

2. Description of the Prior Art

A conventional circuit breaker comprises a housing to accommodate an operation mechanism, a lock catch, a tripping mechanism, a movable contact, an immovable contact, an arc extinguish chamber and a bimetallic strip. Two sides of the housing are provided with binding posts. One end of the bimetallic strip is connected to the binding post at one side of the housing. Another end of the bimetallic strip passes through a brush wire and is connected to the movable contact. The lock catch is hingedly disposed in the housing. The lock catch comprises a lock portion to mate with the operation mechanism and a temporary tripping portion to mate with the tripping mechanism. The tripping mechanism of the conventional mini circuit breaker adopts an electromagnetic tripping device. The coil of the electromagnetic tripping device is connected with the bimetallic strip. When the circuit breaker is in a normal state, the lock catch is biased by a return spring to hold the operation mechanism so that the movable contact and the immovable contact are connected. When a short circuit passes the bimetallic strip and the coil of the electromagnetic tripping device, the magnetic force generated by the coil overcomes the force of the spring to attract an armature to hit a drag rod. The drag rod brings the lock catch to turn by overcoming the action force of the return spring, such that the operation mechanism disengages from the lock catch. Finally, the movable contact is disconnected from the immovable contact to cut off the circuit. The tripping mechanism of the conventional mini circuit breaker adopts the electromagnetic tripping device which is disposed above the arc extinguish chamber. Because the electromagnetic tripping device is large in size and the conventional mini circuit breaker is limited to its entire volume, the size of arc extinguish chamber must be decreased. This limits the breaking capacity and rated current. The width of the housing of the conventional mini circuit breaker is 18 mm, and its rated current only has 63 A.

Accordingly, the inventor of the present invention has devoted himself based on his many years of practical experiences to solve these problems.

SUMMARY OF THE INVENTION

The primary object of the present invention is to provide a pry plate tripping circuit breaker to overcome the shortcomings of the prior art. The present invention has a simple configuration and a lower cost and enhances the breaking capacity and rated current.

In order to achieve the aforesaid object, the pry plate tripping circuit breaker comprises a housing to accommodate an operation mechanism, a lock catch, a tripping mechanism, a movable contact, an immovable contact, an arc extinguish chamber and a bimetallic strip. Two sides of the housing are provided with binding posts. The lock catch is hingedly disposed in the housing. The lock catch comprises a lock portion to cooperate with the operation mechanism and an action portion to cooperate with the tripping mechanism. The trigging mechanism comprises a pry plate unit and a drive unit to drive the pry plate unit to turn. The drive unit comprises a conductive plate which is electrically connected with the bimetallic strip and an electromagnetic induction member disposed on the conductive plate. The pry plate unit comprises a pry plate which is pivotally arranged. One end of the pry plate is provided with an armature to cooperate with the electromagnetic induction member, and another end of the pry plate is located corresponding to the action portion of the lock catch. The pry plate is provided with an elastic member for applying an action force to the pry plate. The action force makes the pry plate corresponding to one end of the armature be away from the electromagnetic induction member.

Thus, when the circuit breaker is in a normal state, the lock catch holds the operation mechanism so that the movable contact and the immovable contact are connected. When a short circuit passes the bimetallic strip, because the conductive plate is electrically connected with the bimetallic strip, the electromagnetic induction member generates electromagnetic induction to bring a magnetic field to attract the armature disposed on the pry plate. When the attraction is larger than the action force of the elastic member, the pry plate will be turned. One end of the pry plate, cooperating with the action portion of the lock catch, makes the lock catch to turn, so that the lock portion of the lock catch disengages from the operation mechanism and the movable contact disconnects from the immovable contact. Therefore, the armature fixed on the pry plate and the electromagnetic induction member fixed on the conductive plate constitute a pry-plate type tripping mechanism instead of the electromagnetic tripping device of the conventional circuit breaker. The configuration of the circuit breaker is simple to lower the cost and to reduce the interior size so that the volume of the arm extinguish chamber is increased to enhance the breaking capacity and rated current. When the width of the housing of the circuit breaker of the present invention is 9 mm, it rated current can be increased to 32 A. When the width of the housing of the circuit breaker of the present invention is 12 mm, it rated current can be increased to 63 A. When the width of the housing of the circuit breaker of the present invention is 18 mm, it rated current can be increased to 125 A. When the width of the housing of the circuit breaker of the present invention is 27 mm, it rated current can be increased to 250 A.

Preferably, the electromagnetic induction member is a magnetic yoke. The magnetic yoke is fixedly disposed in the housing. The conductive plate passes through the magnetic yoke. The magnetic yoke has an opening corresponding to one side of the armature.

Preferably, the tripping mechanism is located between the operation mechanism and the arc extinguish chamber. The lock portion to cooperate with the operation mechanism and the action portion to cooperate with the tripping mechanism are disposed at one side of the lock catch corresponding to the operation mechanism and the tripping mechanism. The conductive plate is bent from one end corresponding to the bimetallic strip to another end toward one side of the operation mechanism.

Thus, the pry plate tripping current breaker is compact and stable.

Preferably, the housing comprises a limit seat therein corresponding in position to the conductive plate to limit the conductive plate. The limit seat has a limit recess to mate with the conductive plate. A portion of the conductive plate is inserted in the limit recess.

Thus, the conductive plate can be secured in the housing firm to enhance the stability of the pry plate tripping current breaker.

Preferably, the housing comprises a fixing seat therein corresponding in position to the magnetic yoke to fix the magnetic yoke. The fixing seat has a boss thereon. The magnetic yoke has a fixing hole corresponding in shape to the boss. Through the fixing hole and the boss, the magnetic yoke is fixed to the fixing seat. The magnetic yoke and the conductive plate are connected by welding.

Thus, the magnetic yoke can be fixed in the housing firm to enhance the stability of the pry plate tripping current breaker.

DETAILED DESCRIPTION OF THE PREFERRED EMBODIMENTS

Embodiments of the present invention will now be described, by way of example only, with reference to the accompanying drawings.

Figure 1:
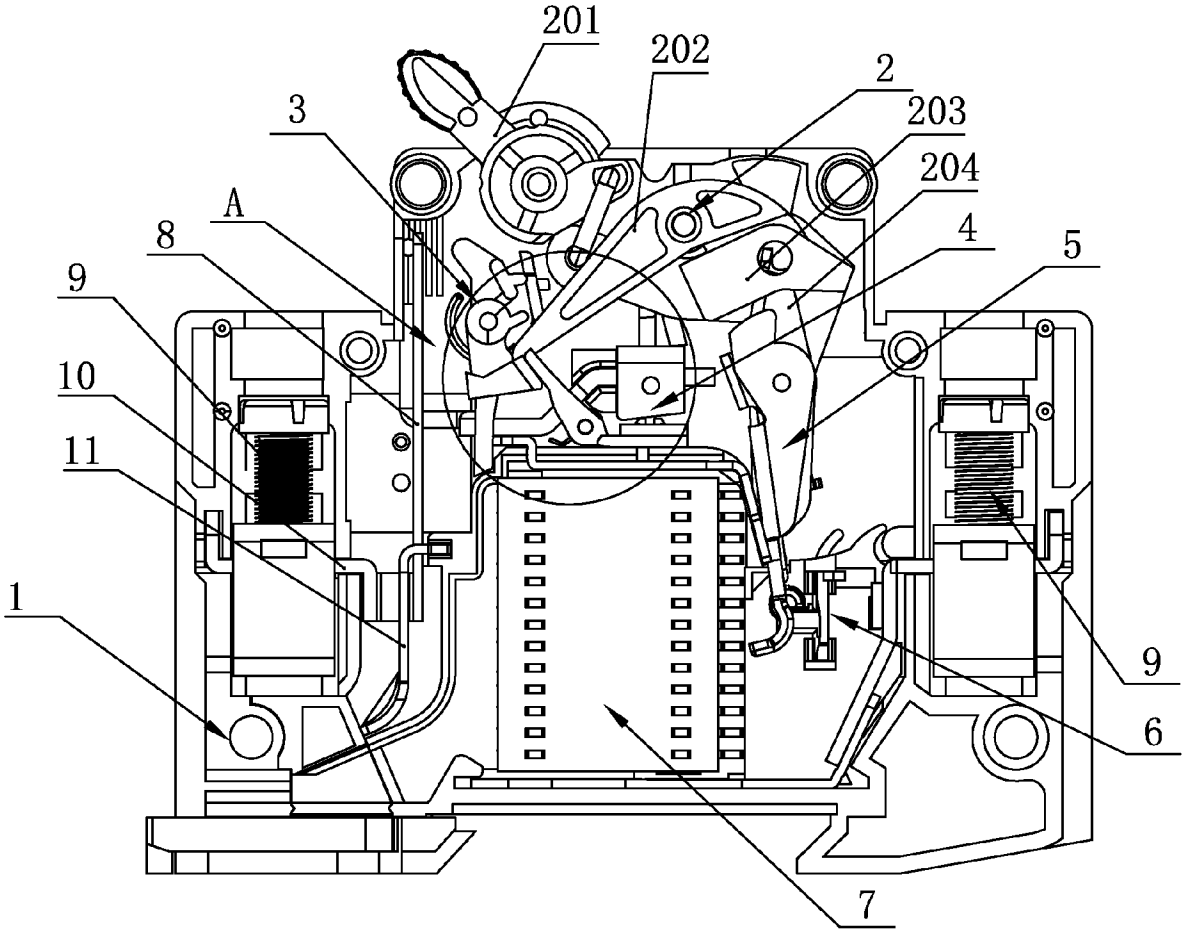
FIG. 1 is a schematic view according to a preferred embodiment of the present invention.
Figure 2:
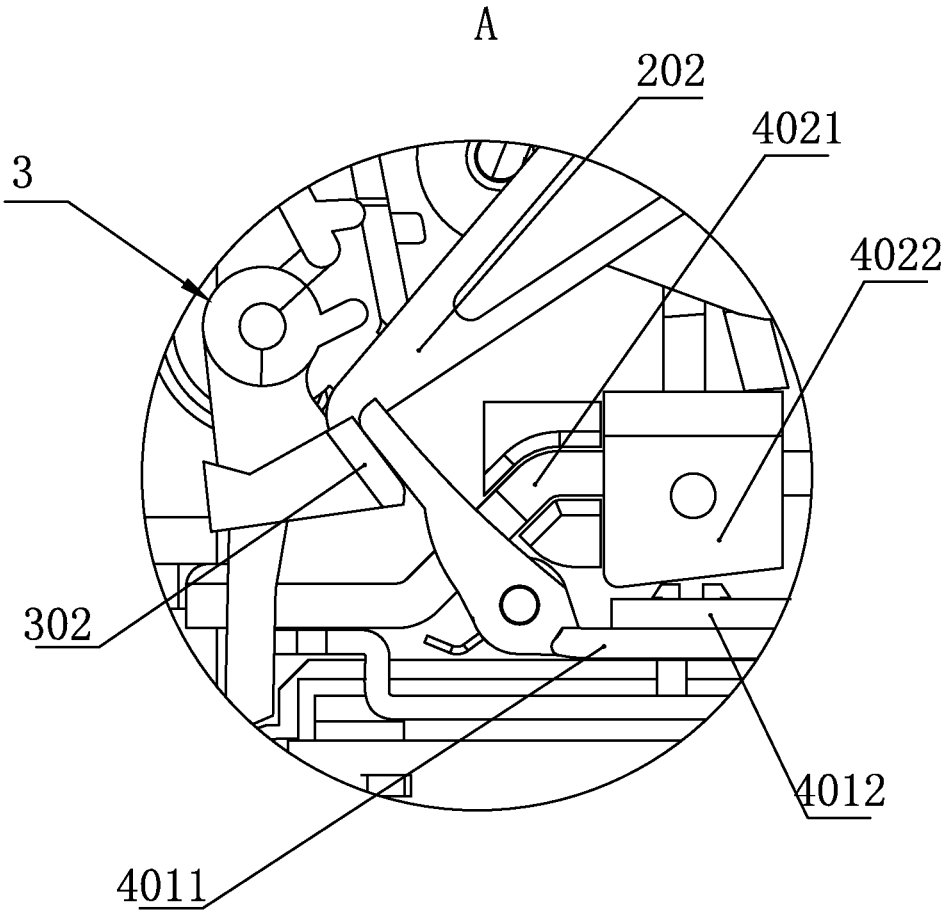
FIG. 2 is an enlarged view of circle A of FIG. 1.
Figure 3:
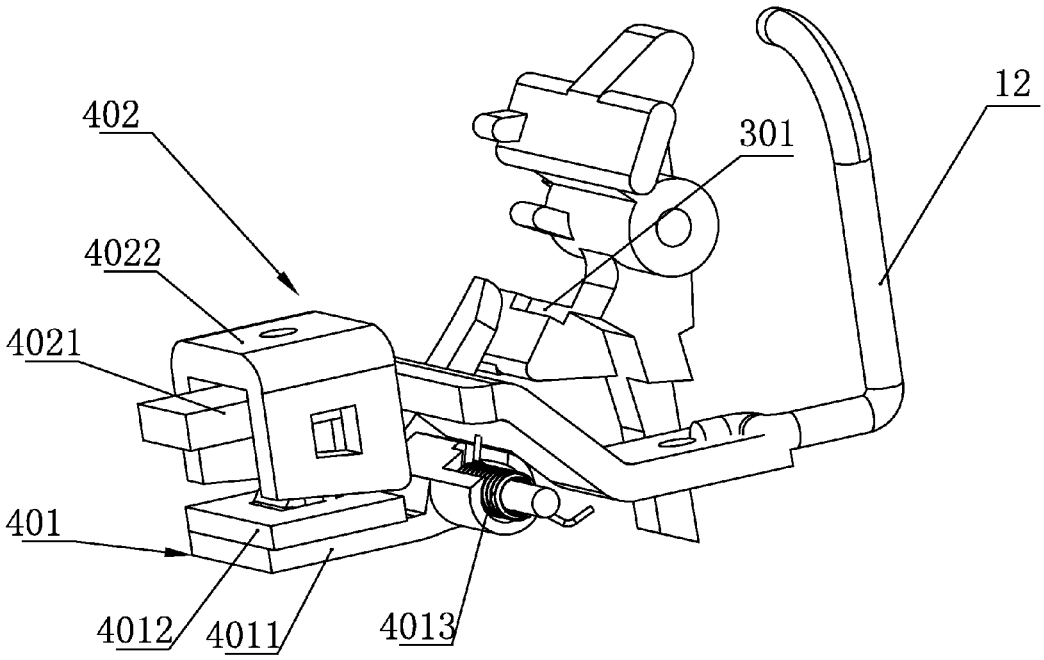
FIG. 3 is a perspective view showing the tripping mechanism and the lock catch of the present invention.
Figure 4:
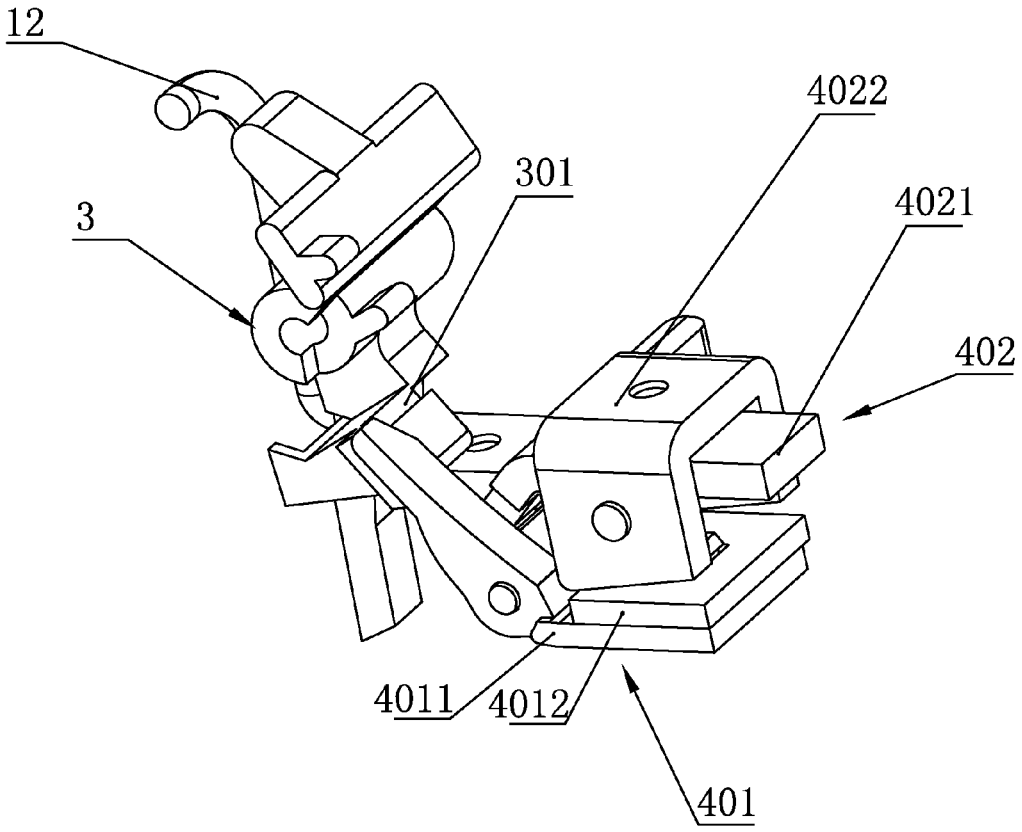
FIG. 4 is another perspective view showing the tripping mechanism and the lock catch of the present invention.
Figure 5:
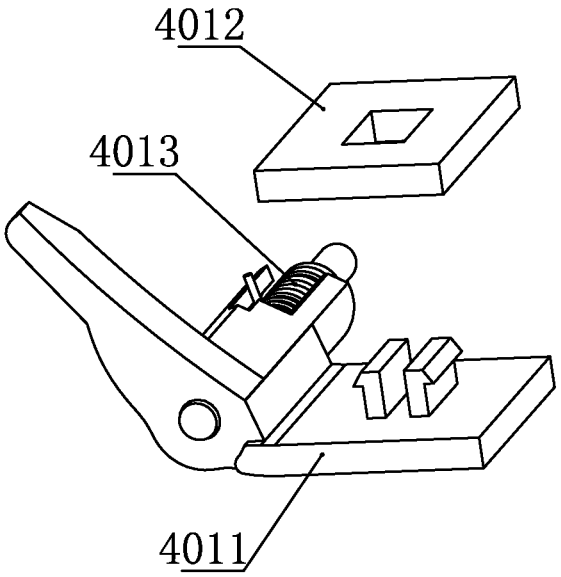
FIG. 5 is an exploded view showing the pry plate unit of the present invention.
Figure 6:
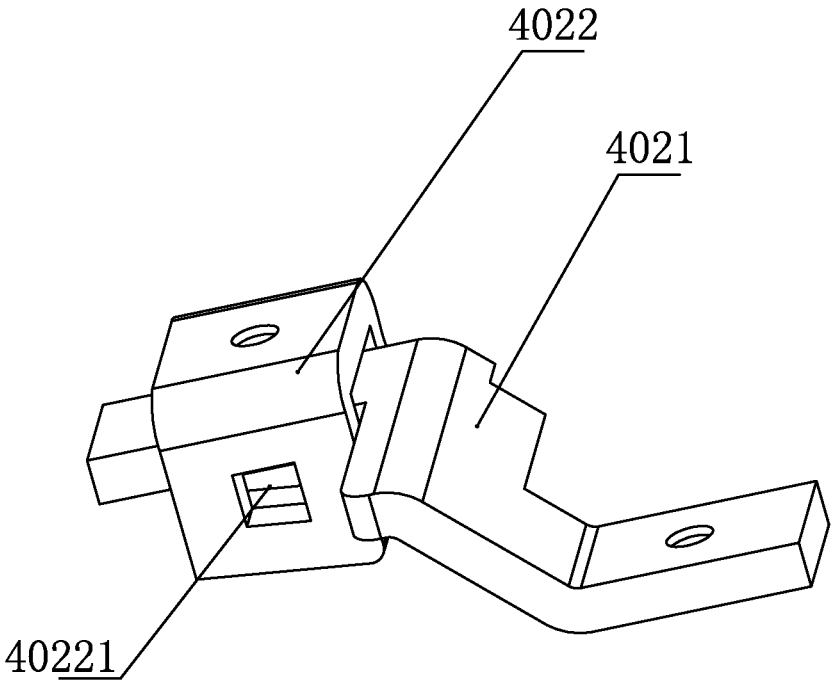
FIG. 6 is a perspective view showing the drive unit of the present invention.
Figure 7:
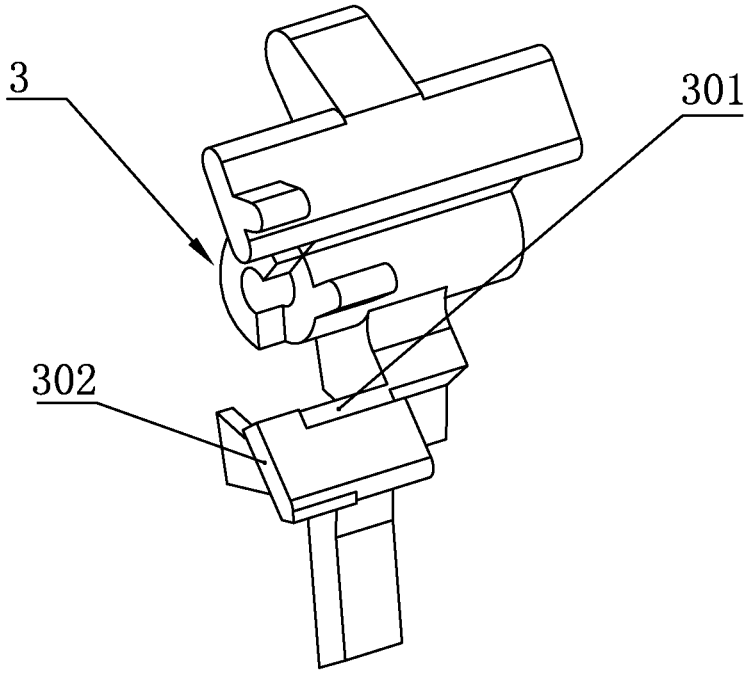
FIG. 7 is a perspective view showing the lock catch of the present invention.
Figure 8:
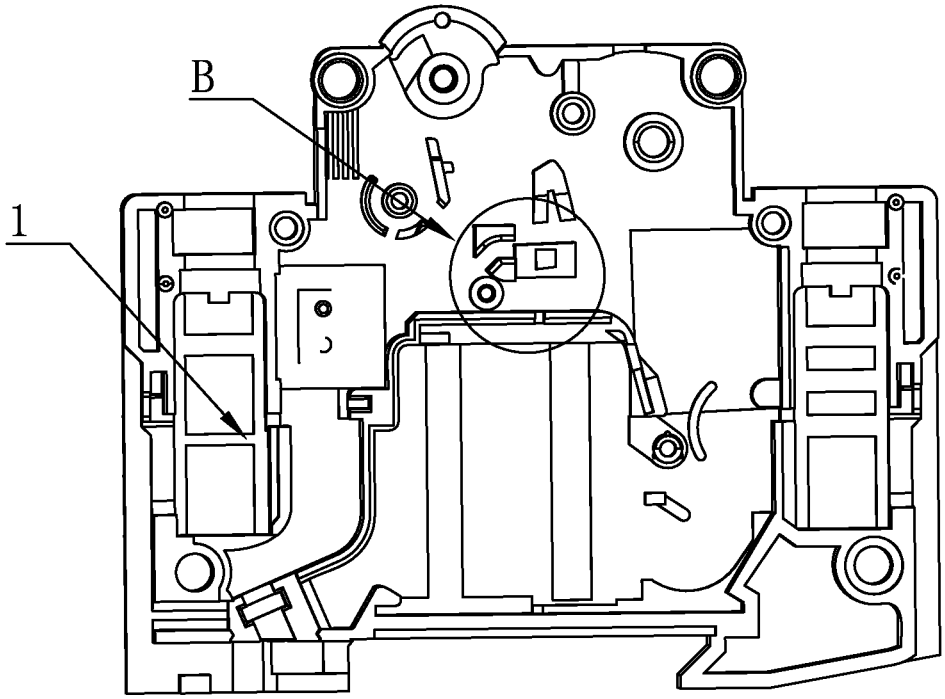
FIG. 8 is a schematic view showing the housing of the present invention.
Figure 9:
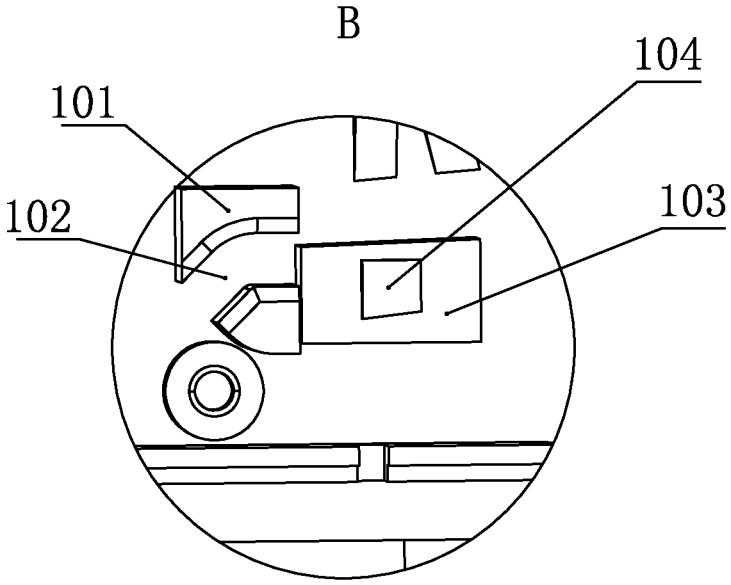
FIG. 9 is an enlarged view of circle B of FIG. 8.

As shown in FIG. 1 to FIG. 9, the present invention discloses a pry plate tripping circuit breaker. The circuit breaker comprises a housing to accommodate an operation mechanism 2, a lock catch 3, a tripping mechanism 4, a movable contact 5, an immovable contact 6, an arc extinguish chamber 7 and a bimetallic strip 8. The operation mechanism 2 comprises a handle 201, a jump pin 202, an indication rod 203, and a support 204 which are linked each other. Two sides of the housing 1 are provided with binding posts 9. The support 204 is linked with the movable contact 5. One end of the bimetallic strip 8 passes through a patch plate 10 and a soft connector 11 and is connected to the binding post 9 at one side of the housing 1. The lock catch 3 is hingedly disposed in the housing 1. The lock catch 3 comprises a lock portion 301 to cooperate with the operation mechanism 2 and an action portion 302 to cooperate with the tripping mechanism 4. The trigging mechanism 4 comprises a pry plate unit 401 and a drive unit 402 to drive the pry plate unit 401 to turn. The drive unit 402 comprises a conductive plate 4021 which is electrically connected with the bimetallic strip 8 and an electromagnetic induction member 4022 disposed on the conductive plate 4021. Preferably, the conductive plate 4021 and the bimetallic strip 8 pass through a conductive wire 12. The pry plate unit 401 comprises a pry plate 4011 which is pivotally arranged. Preferably, the pry plate 4011 is hingedly connected to the housing 1. One end of the pry plate 4011 is provided with an armature 4012 to cooperate with the electromagnetic induction member 4022, and another end of the pry plate 4011 is located corresponding to the action portion 302 of the lock catch 3. The pry plate 4011 is provided with an elastic member 4013 for applying an action force to the pry plate 4011. The action force makes the pry plate 4011 corresponding to one end of the armature 4012 be away from the electromagnetic induction member 4022. Thus, when the circuit breaker is in a normal state, the lock catch 3 holds the operation mechanism 2 so that the movable contact 5 and the immovable contact 6 are connected. When a short circuit passes the bimetallic strip 8, because the conductive plate 4021 is electrically connected with the bimetallic strip 8, the electromagnetic induction member 4022 generates electromagnetic induction to bring a magnetic field to attract the armature 4012 disposed on the pry plate 4011. When the attraction is larger than the action force of the elastic member 4013, the pry plate 4011 will be turned. One end of the pry plate 4011, cooperating with the action portion 302 of the lock catch 3, makes the lock catch 3 to turn, so that the lock portion 301 of the lock catch 3 disengages from the operation mechanism 2 and the movable contact 5 disconnects from the immovable contact 6. Therefore, the armature 4012 fixed on the pry plate 4011 and the electromagnetic induction member 4022 fixed on the conductive plate 4021 constitute a pry-plate type tripping mechanism instead of the electromagnetic tripping device of the conventional circuit breaker. The configuration of the circuit breaker is simple to lower the cost and to reduce the interior size so that the volume of the arm extinguish chamber 7 is increased to enhance the breaking capacity and rated current. When the width of the housing of the circuit breaker of the present invention is 9 mm, it rated current can be increased to 32 A. When the width of the housing of the circuit breaker of the present invention is 12 mm, it rated current can be increased to 63 A. When the width of the housing of the circuit breaker of the present invention is 18 mm, it rated current can be increased to 125 A. When the width of the housing of the circuit breaker of the present invention is 27 mm, it rated current can be increased to 250 A.

In this embodiment of the present invention, the electromagnetic induction member 4022 is a magnetic yoke. The magnetic yoke is fixedly disposed in the housing 1. The conductive plate 4021 passes through the magnetic yoke. The magnetic yoke has an opening corresponding to one side of the armature 4012. Thus, when a short circuit passes the conductive plate 4021, the magnetic yoke generates a magnetic field to attract the armature 4012.

In this embodiment of the present invention, the tripping mechanism 4 is located between the operation mechanism 2 and the arc extinguish chamber 7. The lock portion 301 to cooperate with the operation mechanism 2 and the action portion 302 to cooperate with the tripping mechanism 4 are disposed at one side of the lock catch 3 corresponding to the operation mechanism 2 and the tripping mechanism 4. The conductive plate 4021 is bent from one end corresponding to the bimetallic strip 8 to another end toward one side of the operation mechanism 2. Thus, the conductive plate 4021 gives place to the pry plate unit 401 so that the pry plate tripping current breaker is compact and stable.

In this embodiment of the present invention, the housing 1 comprises a limit seat 101 therein corresponding in position to the conductive plate 4021 to limit the conductive plate 4021. The limit seat 101 has a limit recess 102 to mate with the conductive plate 4021. A portion of the conductive plate 4021 is inserted in the limit recess 102 so that the conductive plate 4021 can be secured in the housing 1 firm to enhance the stability of the pry plate tripping current breaker.

In this embodiment of the present invention, the housing 1 comprises a fixing seat 103 therein corresponding in position to the magnetic yoke to fix the magnetic yoke. The fixing seat 104 has a boss 104 thereon. The magnetic yoke has a fixing hole 40221 corresponding in shape to the boss 104. Through the fixing hole 40221 and the boss 104, the magnetic yoke is fixed to the fixing seat 103. The magnetic yoke and the conductive plate 4021 are connected by welding. Thus, the magnetic yoke can be fixed in the housing firm to enhance the stability of the pry plate tripping current breaker.

Although particular embodiments of the present invention have been described in detail for purposes of illustration, various modifications and enhancements may be made without departing from the spirit and scope of the present invention. Accordingly, the present invention is not to be limited except as by the appended claims.

The invention claimed is:

1. A pry plate tripping circuit breaker, comprising a housing to accommodate an operation mechanism, with two sides of the housing being provided with binding posts, a tripping mechanism.

a lock catch, hingedly disposed in the housing, comprising a lock portion to cooperate with the operation mechanism, and an action portion to cooperate with the tripping mechanism, a movable contact, an immovable contact, an arc extinguish chamber, a bimetallic strip, and the trigging mechanism, comprising a pry plate unit and a drive unit to drive the pry plate unit to turn, comprising a conductive plate electrically connected with the bimetallic strip, and an electromagnetic induction member disposed on the conductive plate, with the pry plate unit comprising a pry plate pivotally arranged, one end of the pry plate provided with an armature to cooperate with the electromagnetic induction member, another end of the pry plate being located corresponding to the action portion of the lock catch, the pry plate provided with an elastic member for applying an action force to the pry plate, the action force making the pry plate corresponding to one end of the armature be away from the electromagnetic induction member, wherein the electromagnetic induction member is a magnetic yoke, the magnetic yoke is fixedly disposed in the housing, the conductive plate passes through the magnetic yoke, and the magnetic yoke has an opening corresponding to one side of the armature.

2. The pry plate tripping circuit breaker as claimed in claim 1, wherein the tripping mechanism is located between the operation mechanism and the arc extinguish chamber, the lock portion to cooperate with the operation mechanism and the action portion to cooperate with the tripping mechanism are disposed at one side of the lock catch corresponding to the operation mechanism and the tripping mechanism, and the conductive plate is bent from one end corresponding to the bimetallic strip to another end toward one side of the operation mechanism.

3. The pry plate tripping circuit breaker as claimed in claim 2, wherein the housing comprises a limit seat therein corresponding in position to the conductive plate to limit the conductive plate, the limit seat has a limit recess to mate with the conductive plate, and a portion of the conductive plate is inserted in the limit recess.

4. The pry plate tripping circuit breaker as claimed in claim 3, wherein the housing comprises a fixing seat therein corresponding in position to the magnetic yoke to fix the magnetic yoke, the fixing seat has a boss thereon, the magnetic yoke has a fixing hole corresponding in shape to the boss, through the fixing hole and the boss, the magnetic yoke is fixed to the fixing seat, and the magnetic yoke and the conductive plate are connected by welding.

* * * * *